United States Patent [19]

Buskell

[11] Patent Number: 4,656,569

[45] Date of Patent: Apr. 7, 1987

[54] ELEVATING APPARATUS PARTICULARLY FOR THE CANOPY OF A LAMP STANDARD

[76] Inventor: Hugh Buskell, 399 King Edward Street, Winnipeg, Manitoba, Canada, R3J 1L6

[21] Appl. No.: 790,129

[22] Filed: Oct. 22, 1985

[51] Int. Cl.[4] ..... F21S 3/12

[52] U.S. Cl. ..... 362/418; 74/89.15; 248/320; 362/431

[58] Field of Search ..... 362/431, 251, 423, 449, 362/418, 382, 289; 248/125, 345, 669, 320, 405; 74/89.15, 424.8 R

[56] References Cited

U.S. PATENT DOCUMENTS

| | | | |
|---|---|---|---|
| 348,226 | 8/1886 | Mayhew | 74/89.15 |
| 428,723 | 5/1890 | Jeffers | 248/320 |
| 3,728,903 | 4/1973 | Haller | 74/424.8 R |
| 3,858,452 | 1/1975 | Gatland | 74/89.15 |
| 4,237,530 | 12/1980 | Murray et al. | 362/431 |

*Primary Examiner*—William A. Cuchlinski, Jr.
*Assistant Examiner*—D. M. Cox
*Attorney, Agent, or Firm*—Adrian D. Battison; Stanley G. Ade

[57] ABSTRACT

An assembly for elevating particularly a lamp canopy on a lamp standard comprises a screw arranged longitudinally of the standard and rotatable at a lower end to drive the canopy up and down the mast. The screw is located in a channel formed by flanges exterially of the mast. Nuts separate from the canopy can be moved up and down the screw to support cables to the lamp and to stabilize the screw. The channel can be covered by cover plates applied to the channel and carried along the channel by the raising canopy.

16 Claims, 8 Drawing Figures

ELEVATING APPARATUS PARTICULARLY FOR THE CANOPY OF A LAMP STANDARD

BACKGROUND OF THE INVENTION

This invention relates to elevating apparatus particularly but not exclusively for the lamp canopy of a lamp standard.

In many cases the lamp canopy of a lamp standard is attached permanently at the top of the standard and can be reached only by either lowering the standard or by an elevating bucket in which a service operative can be lifted to reach the lamp canopy.

However it will be appreciated that these techniques are highly disadvantageous in that they require considerable equipment dedicated to the particular function. Even in relation to street lighting with a large number of such lamps to be serviced and hence the cost of the equipment can be accepted there are many disadvantages for example interference with traffic and danger. Certainly in other cases where a user has only one or two such standards for example for flood lighting tennis courts, the cost of the equipment cannot of course be justified.

Various proposals have been made for arrangements for elevating the canopy from a service level adjacent the ground to an elevated level at the top of the mast or standard. Generally equipment of this type comprises a pulley arrangement at the top of the mast and cables which run up inside the mast over the pulley so that the canopy can be raised and lowered along the mast. Such arrangements are disadvantageous in that a major part of the equipment is at the top of the mast and any failure of course will require servicing by elevated bucket arrangement.

SUMMARY OF THE INVENTION

It is one object of the present invention, to provide an improved elevating apparatus which may be used with a lamp standard of this type for raising and lowering the canopy.

According to a first aspect of the invention, therefore, there is provided a light standard comprising an elongate tubular mast, a light canopy for positioning at the top of the mast for projecting light therefrom over an area to be illuminated and elevating means for raising and lowering said canopy from a service position at a lower end of the mast to an elevated position at said top of the mast, said elevating means comprising an externally screw threaded shaft, means mounting the shaft on the tubular mast on an outer face thereof and extending from said service position to said elevated position, said mounting means being arranged to hold said shaft against movement longitudinally of the mast while allowing rotation of the shaft about a longitudinal axis of the shaft, collar means attached to said canopy for movement therewith and for engaging said shaft and including a screw thread member, and drive means for rotating the shaft whereby rotation of the shaft drives the collar means longitudinally of the shaft.

According to a second aspect of the invention there is provided apparatus for elevating equipment from a service position adjacent the ground to a raised working position comprising an elongate channel member arranged to extend from said service position to said raised position, an elongate externally screw threaded shaft, means mounting said shaft within and extending along said channel member for rotation about an axis of the shaft, collar means for attachment to said equipment including a screw thread for engaging said shaft and cooperating with said external screw thread thereof, means within said channel member and extending therealong for preventing rotation of said collar means relative to said shaft whereby rotation of the shaft causes elevating movement of said equipment from said service position to said raised position and vice versa, and at least one shaft stabilizing member including means for preventing lateral movement thereof relative to said channel member and movable along said shaft from one of said service position and said raised position to an intermediate position along the length of the shaft.

Preferably therefore the threaded shaft or screw arrangement is mounted on an exterior surface of the mast in a channel defined by upstanding flanges and is therefore open to ready view and inspection.

The channel can be covered by a cover plate arranged in sections which can be drawn along the channel by the lifting canopy with each section being joined to the next and then pulled along the channel so that it becomes fully closed and inaccessible to moisture.

The screw can be stabilized at spaced positions along its length by stabilizing members which run up the screw after being attached to the screw at the spaced positions. The stabilizing members can also carry the wires from the canopy thus providing support for the weight of the wires at spaced positions down the mast. The screw arrangement also provides careful and accurate control of the movement of the canopy bearing in mind the substantial weight of the canopy.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
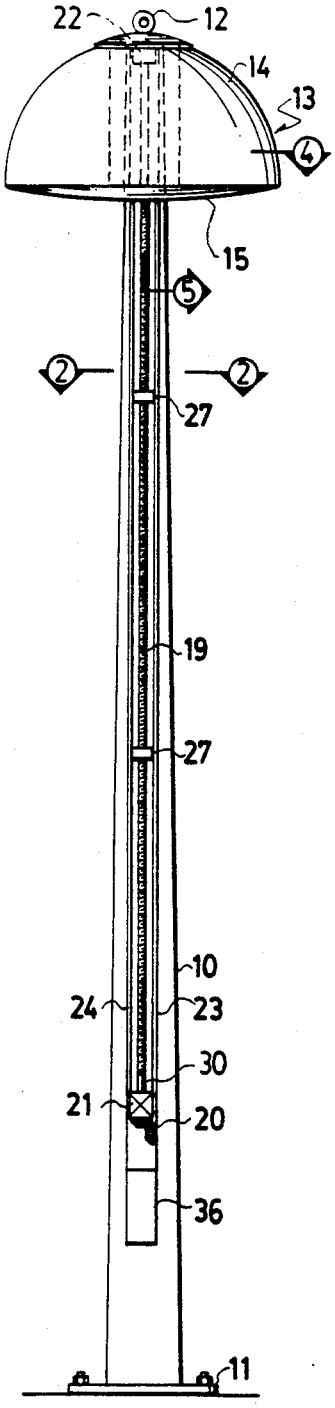
FIG. 1 is a front elevational view of an apparatus for elevating the canopy of a lamp on a mast according to the invention.
Figure 2:
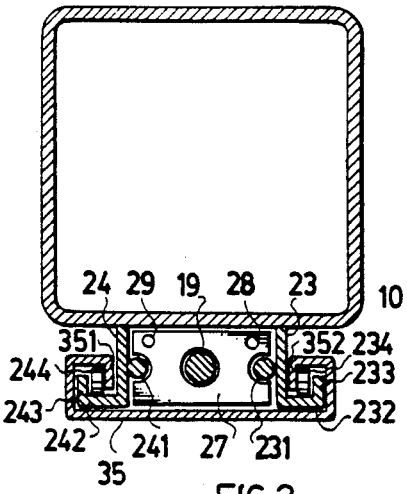
FIG. 2 is a cross sectional view along the lines 2—2 of FIG. 1.

A lamp standard or mast is indicated at 10 in FIG. 1 and is of generally square cross section as shown best in FIG. 2 tapering from a larger dimension at the base to a smaller dimension at the top as is conventional and well known.

The base includes a flange 11 by which the mast can be bolted to the ground in conventional manner. The narrower top includes a ring 12 by which the mast can be grasped and raised into an elevated position for initial installation.

Figure 4:
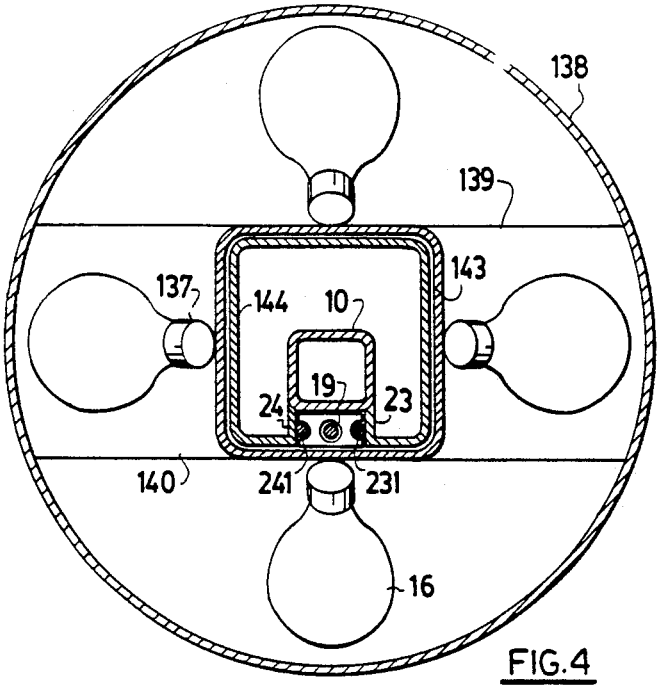
FIG. 4 is a cross sectional view of the canopy taken along the line 4 of FIG. 1.
Figure 5:
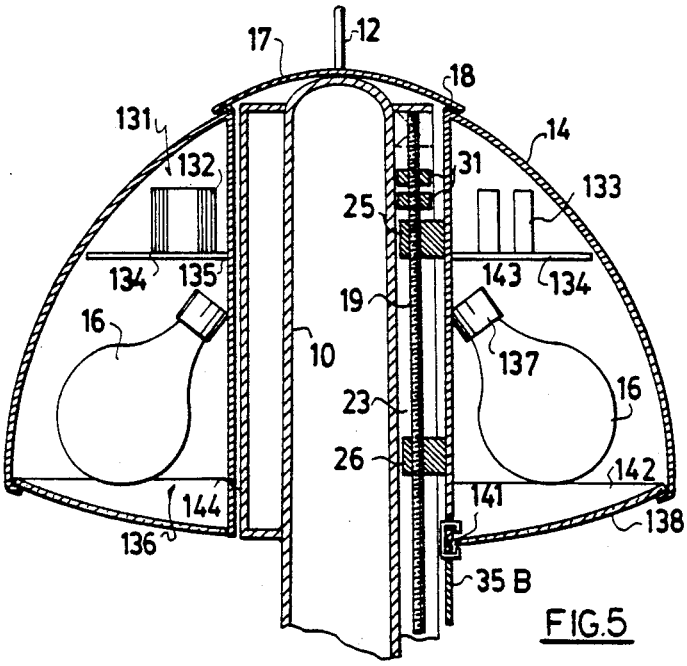
FIG. 5 is a cross sectional view of the canopy and upper part of the mast taken along the line 5 of FIG. 1.

A lamp canopy is generally indicated at 13 and comprises a substantially hemispherical bowl 14 and a lens section 15 on the underside of the canopy for directing light from a plurality of light bulbs 16 shown in FIGS. 4 and 5. The ring 12 as best shown in FIG. 5 is attached to the top of the mast. A surrounding flange 17 is also attached to the top of the mast and extends outwardly around the top of the mast and also curves downwardly with a cross section of a sector of a circle for engaging and receiving an upper area of the bowl 14. A gasket 18 is positioned between the flange 17 and the bowl 14 to avoid the entry of moisture. The canopy encloses or defines an upper section 131 which houses a transformer 132 and other related equipment of conventional type generally indicated at 133. The electrical equipment is mounted upon panels 134 which can pivot about hinges 135 to allow it to be accessed for service simply from the underside of the canopy. Within a lower portion of the canopy defining a lighting chamber 136 are mounted four or two light bulbs generally indicated at 16 on mountings 137. Lenses are mounted on the underside of the canopy indicated at 138 in the form of part circular portions which hinge about a line 139 to allow access to the bulbs. Additional sections 140 can be positioned in between the sections 138 to complete the circular area defining the underside of the canopy. So that light is directed outwardly from the mast, the underside of the lens inclines upwardly from a lower most inner point 141 to the edge of the canopy 142.

To obtain raising and lowering movement of the canopy 13, a front face of the mast carries a screw member 19 or threaded shaft extending from a bevel gear 20 at a service height substantially to the top of the mast. The shaft or screw 19 is mounted in bearings 21 and 22 at the bottom and top respectively of the shaft with the bearings being received between two flanges 23, 24 which extend outwardly from a front face of the mast at a spacing substantially equal to the width of the mast at the upper end thereof. Welded to the inside face of each of the flanges 23, 24 is a guide shaft 231, 241 which acts to define an area within the channel formed by the outer face of the mast and the flanges along which a plurality of "nuts" can slide each having an internal screw thread and controlled by the rotation of the screw 19. Thus the canopy includes an upper nut 25 and a lower nut 26 which are shaped as stated to run along the channel and include an internal screw thread cooperable with the shaft 19. Thus rotation of the shaft caused by actuation of the bevel gears 20 causes the nuts 25 and 26 and therefore the canopy to raise and lower on the shaft 19.

Turning now to FIG. 2, there is shown a further nut 27 which is arranged to grasp a pair of wires 28, 29 depending downwardly from the canopy which are the leads or wires supplying power and control to the canopy from the base of the mast. As will be appreciated the weight of the wires over a high mast is quite significant and it is therefore very desirable to support the wires at spaced positions along the mast. Thus a plurality of such nuts 27 is provided along the length of the mast with each nut grasping the wires at a spaced position to provide support for the wires over the height of the mast.

In order to position the nuts 27 in the required location relative to the length of the wire, when the canopy is in a lowered position at the service height, the nuts 27 are stored on a length 30 of the screw 19 which is free from screw thread and thus when on that position, rotation of the screw does not drive the nuts 27 upwardly along the screw. When the canopy is being raised, the operator acts to wait until the length of wire depending through the canopy is substantially taut between the canopy and the first nut 27 following which the nut 27 is applied to the screw thread and follows the canopy along the screw thread to support the wires at the required spacing.

Figure 6:
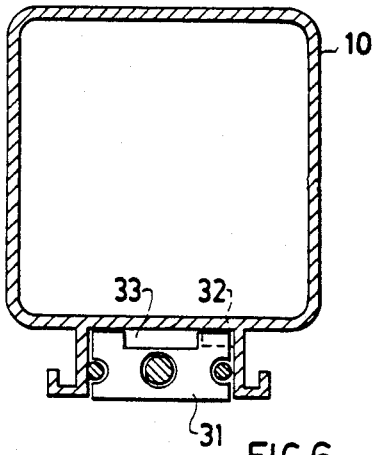
FIG. 6 is a cross sectional view showing one of the stabilizing members of FIG. 5 at a stabilizing position in the mast.
Figure 7:
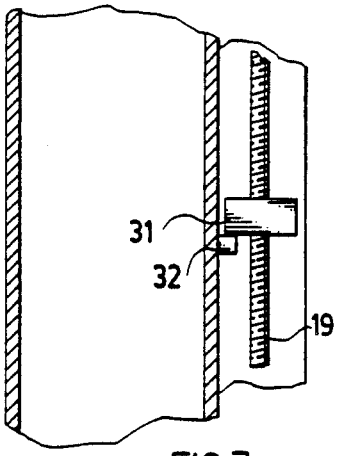
FIG. 7 is a cross sectional view along the lines 7—7 of FIG. 6.

Conversely, when the canopy is carried down the mast by the screw 19, the nuts 27 also work their way down the screw to the section 30. In order to stabilize the screw 19 as the canopy is lowered, that is in the section of the screw above the canopy, a plurality of nuts 31 are carried on the screw above the nut 25 of the canopy. These can operate either in a similar manner to the nuts 27 that is they are stored on a piece of the screw which is free from screw thread and then are screwed down the screw in turn or they can be freely sliding on the outside of the screw thread. In each case they are stopped in spaced positions along the length of the mast by stop members or cams 32 shown best in FIGS. 6 and 7. Each of the nuts 31 has a cut out portion 33 which enables it to pass over one or more of the stop members 32 with the size of the cut out being varied in dependence upon the required stop position of that particular nut.

In view of the fact that the mast tapers from the service position to the upper elevated position, an internal opening in the canopy defined by an inner surface 143 is shaped to match the cross sectional dimension of the mast at the service elevation. At the elevated position, therefore, the internal opening 143 does not match the outer surface of the mast and the flanges 23, 24 and therefore a dummy piece 144 is attached to the mast at the upper end over the length of the mast substantially equal to the height of the canopy. This dummy piece is best seen in FIGS. 4 and 5 and consists of a shell of substantially rectangular cross section welded to the outer edges of the flanges 24, 23. The size of the dummy piece of course depends upon the height of the mast since higher masts of course require a larger base dimension in accordance with a good engineering practice.

Figure 3:
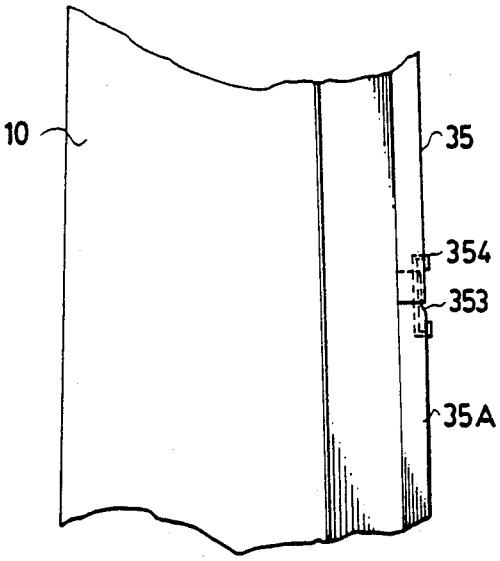
FIG. 3 is a side elevational view on an enlarged scale of the portion of the mast as illustrated in FIG. 2.

Turning now to FIGS. 2 and 3, the flanges 23 and 24 as shown have on a front edge a turned over portion 232, 242 respectively defining a flange 233, 243 parallel to but spaced outwardly of the respective flange 23, 24. This flange 233, 243 provides an inner surface supporting a roller 234, 244 which in turn supports a flange 351, 352 of a cover plate 35. Thus the cover plate 35 similarly includes the turned over portion at the edges which cooperate with the turned over portion of the flanges so that the cover plate can run along the channel member defined by the flanges and close the front face thereof. The cover plate 35 forms one of a plurality of such cover plates two of which are shown in FIG. 3 at 35 and 35A respectively. An upper edge of the lower plate 35A is formed at 353 so as to underly the edge of the upper plate 35 to prevent moisture from entering at the junction between the plates. The plates are held together by a C-shaped clamping member 354 with a front flange thereof passing through a slot in each of the plates 35, 35A respectively. The upper most plate 35B is attached by a similar technique to the lower edge of the inner face of the canopy as shown best in FIG. 5 so that as the canopy is lifted up the mast by the screw 19, each cover plate 35 in turn can be hooked on initially to the canopy and then to the following cover plates so thay are all pulled up along the channel member to cover the complete channel.

Figure 8:
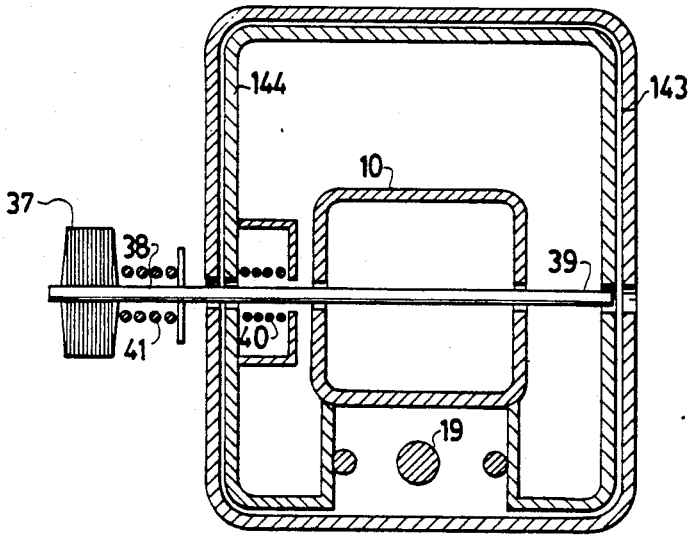
FIG. 8 is a cross-sectional view showing the canopy in the raised position and including a locking mechanism for retaining the canopy in the raised position.

A final cover panel (not shown) is arranged to be lockable in position over the mechanical section comprising the gear box and bearings 20, 21 and also an electrical section indicated at 36 at the service level of the mast. Thus the lockable cover panel acts to secure all of the slidable cover panels in a manner which prevents access to the equipment by the public. The electrical section 36 can include the main breaker switch and also various other electrical equipment including a locking mechanism for the canopy at the upper edge as shown in FIG. 8.

The locking mechanism comprises a solenoid 37 controlled by a suitable switch in the electrical section 36 for actuating a shaft 38 which passes through the wall 143 defining the inner face of the canopy into the wall 144 of the dummy section for actuating a second rod 39 which passes through the dummy section and through the mast and back through the walls 143, 144. Thus when the canopy is fully raised, the solenoid 37 can be actuated to insert the rods 38, 39 into a locking position following which the canopy can be screwed down slightly to retain the rods latched in locking position. At this time a locking pin (not shown) can also be applied to the screw 19 adjacent the lower end to lock the whole assembly into the elevated position. When it is required to lower the canopy, the canopy can be initially raised slightly compressing the flange 18 shown in FIG. 5 at which time the springs 40, 41 act to withdraw the locking bars 38, 39 to a released position so that the canopy can be lowered.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A light standard comprising an elongate tubular mast, a light canopy for positioning at the top of the mast for projecting light therefrom over an area to be illuminated and elevating means for raising and lowering said canopy from a service position at a lower end of the mast to an elevated position at said top of the mast, said elevating means comprising an externally screw threaded shaft, means mounting the shaft on the tubular mast on an outer face thereof and extending from said service position to said elevated position, said mounting means being arranged to hold said shaft against movement longitudinally of the mast while allowing rotation of the shaft about a longitudinal axis of the shaft, collar means attached to said canopy for movement therewith and for engaging said shaft and including a screw thread member, and drive means for rotating the shaft whereby rotation of the shaft drives the collar means longitudinally of the shaft.

2. The invention according to claim 1 including means for covering the shaft along the length thereof.

3. The invention according to claim 2 wherein the covering means comprises means defining a channel on an outer surface of said mast with an open face of said channel facing outwardly from said mast and cover plate means for closing said open face and movable along said channel.

4. The invention according to claim 3 wherein said cover plate means is arranged to be drawn along the channel by elevating movement of said canopy.

5. The invention according to claim 3 wherein the cover plate means is formed in separate pieces which can be coupled together and which can be attached individually to said channel.

6. The invention according to claim 2 wherein said covering means comprises a channel member defined by a pair of spaced parallel flanges each extending outwardly from said mast and cover plate means in a plurality of separate pieces, each piece having means for engaging on said flanges such that the piece can slide along said flanges from said service position to a raised position, said flanges and cover plate pieces have cooperating means for preventing removal thereof except at said service position.

7. The invention according to claim 1 including at least one shaft stabilizing member having a screw thread for cooperation with said external screw thread and means for engaging said mast to prevent rotation of said stabilizing member about said shaft whereby rotation of said shaft moves said stabilizing member therealong and whereby said engagement between said stabilizing member and said mast stabilizes said shaft at said stabilizing member, said shaft having a portion thereof free from said screw thread whereby to receive for storage said stabilizing member.

8. The invention according to claim 7 wherein said canopy includes electrical wires for communication of power from a position adjacent the bottom of the mast to the elevated position, said at least one stabilizing member including means for clamping said wires whereby to transport said wires up said shaft with said stabilizing member and support the weight thereof at spaced positions between said canopy and said bottom of the mast.

9. The invention according to claim 1 including at least one shaft stabilizing member positioned above said collar means for sliding on said shaft whereby to follow said collar means down said shaft as said collar means is lowered from the elevated position and stop means on said mast for halting said stabilizing member at a position spaced from said elevated position and said service position whereby to stabilize the shaft at said stop means.

10. The invention according to claim 1 wherein the mast is tapered from the bottom thereof toward the top thereof and wherein a dummy piece matching the shape of the mast at the service position is attached to the mast at the elevated position whereby the canopy surrounds and is supported by said dummy piece at said elevated position.

11. The invention according to claim wherein the mast includes a surrounding flange at the top thereof and wherein the canopy is arranged to cooperate with and engage said flange.

12. The invention according to claim 1 including solenoid actuated locking means movable transversely to the mast to lock said canopy to said mast in the elevated position.

13. Apparatus for elevating equipment from a service position adjacent the ground to a raised working position comprising an elongate channel member arranged to extend from said service position to said raised position and including a a pair of spaced parallel flanges extending outwardly from a base thereof, an elongate externally screw threaded shaft, means mounting said shaft within and extending along said channel member for rotation about an axis of the shaft, collar means for attachment to said equipment including a screw thread for engaging said shaft and cooperating with said external screw thread thereof, means within said channel member and extending therealong for preventing rotation of said collar means relative to said shaft whereby rotation of the shaft causes elevating movement of said equipment from said service position to said raised position and vice versa, at least one shaft stabilizing member including means for prevent-lateral movement thereof relative to said channel member and movable along said shaft from one of said service position and said raised position to an intermediate position along the length of the shaft and cover plate means in a plurality of separate pieces, each piece having means for engaging on said flanges such that the piece can slide along said flanges from said service position to said raised position, said flanges and cover plate pieces having cooperating means for preventing removal thereof except at said service position.

14. Apparatus for elevating equipment from a service position adjacent the ground to a raised working position comprising an elongate channel member arranged to extend from said service position to said raised position, an elongate externally screw threaded shaft, means mounting said shaft within and extending along said channel member for rotation about an axis of the shaft, collar means for attachment to said equipment including a screw thread for engaging said shaft and cooperating with said external screw thread thereof, means within said channel member and extending therealong for preventing rotation of said collar means relative to said shaft whereby rotation of the shaft causes elevating movement of said equipment from said service position to said raised position and vice versa, and at least one shaft stabilizing member including means for preventing lateral movement thereof relative to said channel member and movable along said shaft from one of said service position and said raised position to an intermediate position along the length of the shaft, wherein the shaft stabilizing member is arranged beneath said collar means and includes a screw thread for coperation with said external screw thread of said shaft whereby rotation of said shaft moves said stabilizing member therealong, said shaft having a portion thereof free from said external screw thread whereby to receive for storage said stabilizing member.

15. The invention according to claim 14 wherein said equipment includes flexible supply means extending therefrom to the service position and wherein said shaft stabilizing member includes means for clamping said flexible supply means whereby to support the weight thereof at a position spaced from said equipment.

16. The invention according to claim 14 including a plurality of said stabilizing members and a plurality of stop means, said plurality of stop means being arranged at spaced positions along the length of the channel member, said stop means and said stabilizing members being arranged such that a first stabilizing member is halted at an uppermost one of said stop members while other stabilizing members pass said uppermost stop member for engaging lower stop members.

* * * * *